US008342987B2

(12) United States Patent
Shaw et al.

(10) Patent No.: US 8,342,987 B2
(45) Date of Patent: Jan. 1, 2013

(54) FOOTBALL HOLDER FOR PLACE KICKING AND METHOD FOR MAKING AND USING FOOTBALL HOLDER FOR PLACE KICKING

(76) Inventors: Chris Shaw, Fairview, TX (US); Rocky Willingham, Dallas, TX (US); Vincent Mark Villanueva, Garland, TX (US)

( * ) Notice: Subject to any disclaimer, the term of this patent is extended or adjusted under 35 U.S.C. 154(b) by 0 days.

(21) Appl. No.: 12/232,214

(22) Filed: Sep. 11, 2008

(65) Prior Publication Data

US 2010/0062879 A1 Mar. 11, 2010

(51) Int. Cl.
*A63B 69/00* (2006.01)

(52) U.S. Cl. ..... 473/419; 473/420

(58) Field of Classification Search ..... 473/416–420, 473/439, 398–402
See application file for complete search history.

(56) References Cited

U.S. PATENT DOCUMENTS

| | | | | |
|---|---|---|---|---|
| 3,897,948 | A * | 8/1975 | Gerela | 473/419 |
| 4,807,880 | A * | 2/1989 | Deal | 473/419 |
| 5,088,740 | A * | 2/1992 | Peterson | 273/410 |
| 5,464,209 | A * | 11/1995 | Sang | 473/419 |
| 5,505,445 | A * | 4/1996 | Treadwell et al. | 473/419 |
| 6,719,650 | B1 * | 4/2004 | Thurlow | 473/420 |

* cited by examiner

*Primary Examiner* — Mark Graham

(57) ABSTRACT

A collapseable, and self-assembling football holder for kicking a football that replaces the need for another person to hold the football for placekicking while simulating a placeholder for the place kicker.

2 Claims, 4 Drawing Sheets

FOOTBALL HOLDER FOR PLACE KICKING AND METHOD FOR MAKING AND USING FOOTBALL HOLDER FOR PLACE KICKING

BACKGROUND OF THE INVENTION

1. Field of the Invention

The present invention relates to a portable football holding device, and more specifically to a football holder for place kicking that does not require the assistance of a person.

2. Background Information

American football, known in the United States and Canada simply as football, is a competitive team sport. Outside of the United States and Canada, the sport is usually referred to as American football (or sometimes as gridiron or gridiron football) to differentiate it from other football games. American football is the most popular spectator sport in the United States.

Both American football and soccer have their origins in varieties of football played in the United Kingdom in the mid-19th century, and American football is directly descended from rugby football. The ball used in American football has a pointed prolate spheroid shape, also known as the vesica piscis shape, and has a large set of stitches along one side.

In surveys of Americans, pluralities of respondents consider it to be their favorite sport. Football's TV viewership ratings far surpass those of other sports. College football is also popular throughout North America. Four college football stadiums (Michigan Stadium, Beaver Stadium, Neyland Stadium, Ohio Stadium), seat more than 100,000 fans and regularly sell out. Even high school football games can attract more than 10,000 people in some areas. The weekly autumn ritual of college and high-school football—which includes marching bands, cheerleaders and parties (including the ubiquitous tailgate party)—is an important part of the culture in much of small town America. It is a long-standing tradition in the United States (though not universally observed) that high school football games are played on Friday, college games on Saturday, and professional games on Sunday (with an additional professional game on Monday nights). Football is played recreationally by children of all ages and grades, amateur clubs and youth teams (e.g., the Pop Warner little-league programs). There are also many "semi-pro" teams in leagues where the players are paid to play but at a small enough salary that they generally must also hold a full-time job.

One of the key players in any football team is the placekicker, or simply kicker. The placekicker is the title of the player in American and Canadian football who is responsible for the kicking duties of field goals, extra points, and, in many cases, kickoffs. Professional placekickers sometimes earn over a million dollars per year in salary. To obtain expertise in place kicking, football place kickers must spend many hours place kicking in order to improve both the strength and accuracy of their specialty. In the past, however, it has been necessary to have a cooperative holder, or a second person, to hold the football, like during a live game. A holder, then, represents an inefficient use of manpower and necessarily prevents the place kicker from practicing on his own. As a result, a number of devices for holding the football to temporarily replace the holder have been developed, but none with much commercial success.

These devices include, for example, the device shown in U.S. Pat. No. 5,464,209, issued to Sang on Nov. 7, 1995, is entitled "Portable football holder". This device is a portable football holder that includes two mutually pivotable legs with one leg having an end designed to engage the tip of a football to hold the football in an upright position, and with the other leg being connected to a V-shaped base. The V-shaped base is designed to sit on a ground surface to support the portable football holder. However, the Sang invention is not fully collapsible as it has rigid parts, like its elbows 31, 33 and the apex 17. Therefore, the Sang invention cannot disassemble, pack and store as readily as the present invention.

U.S. Pat. No. 5,505,445, issued to Treadwell on Apr. 9, 1996, is entitled "Football kicking tee". This device is a kicking tee for holding a football in an upright position for kicking, comprises first, second and third legs having respective first and second end portions. The first and second legs first end portions are secured together to form an inverted "V" in a substantially vertical plane with the first and second legs second end portions engaging the ground. The third leg first end portion is secured to the first and second legs first end portions such that the third leg is disposed substantially horizontally when the third leg second end portion engages the tip of the football.

However, unlike the present invention, the Treadwell invention does not fold into less than half of its working height, and is complex given its pivot structure. In contrast, the simple and inexpensive integrated bungee cords provide all that is necessary to fold the present invention into its compact structure for easy storage and portability and to snap it into ready position when taken out of its storage pouch.

U.S. Pat. No. 4,946,165, issued to Rambacher on Aug. 7, 1990, is entitled "Football holder for place-kicking". This device includes a base, a vertical stem, and a pivotable arm adapted to hold the football from one end thereof, so that it may be retained in a proper position for place kicking. However, with a knob-turning adjustable tensioning mechanism to control the amount of tension applied to the football as it is being held, the '165 invention is quite complex, and must be carefully readjusted for varying sizes of footballs.

Another football holding device is disclosed in U.S. Pat. No. 4,546,974, issued to Brown on Oct. 15, 1985, is entitled "Football holding device". Although the Brown device can accommodate footballs of various sizes, it includes springs or other elastic-type members to cause the holding arm to swing up and away from the path of the kicker's foot. However, the Brown device is still a rather complex and not a foolproof mechanism.

A number of additional football holding devices are also known, each of which includes a holding arm placed above a base whose other end is intended to contact the end of a football. These include U.S. Pat. No. 4,632,395, issued to Ferrebee on Dec. 30, 1986, is entitled "Football place/field goal kicking device". It includes a 3-element arm pivotally and serially connected to each other and is intended to fall to the side after kicking and therefore not interfere with the kicker's foot.

Additionally, U.S. Pat. No. 4,634,122, issued to Kline on Jan. 6, 1987, is entitled "Holder for football place-kicking practice". This device, which includes a flexible finger attached to an arm, holds the football in position on a kicking tee.

U.S. Pat. No. 3,897,948, issued to Gerela, discloses yet another football place kicking device which in this case simply includes supporting shaft 6 on a base 4 and a tubular flexible arm 18 which is received in a reduced cross-section 16 of the shaft. Arm 18 in this case is said to be made of a semi-rigid material, meaning that it is deformable but will resume its original shape. A plastic garden hose is specifically referred to therein.

Finally, U.S. Pat. No. 4,807,880, issued to Deal on Feb. 28, 1989, is entitled "Ball support device". The device incorporates a rigid J-spike having a rigid permanent configuration.

It is desirable to have a simpler and more effective (American) football holding device that effectively simulates a person holding the football—but not needing the assistance of anyone—while not interfering with the kicker, and provides proper placement of the football for repetitive, authentic use.

It is also desirable to have such a football holder be affordable and portable.

SUMMARY OF THE INVENTION

It is an object of the present invention to overcome the foregoing disadvantages and limitations of the prior art.

In view of the preceding, it is an object of this present invention to provide a football holder for kicking a football that can be disassembled into a compact and still be lightweight in structure.

It is another object of this present invention to provide a football holder for kicking a football that is easily disassembled, portable and easily stored.

It is another object of this present invention to provide a football holder for kicking a football that is very simple to set up and operate.

It is another object of this present invention to provide a football holder for kicking a football that is inexpensive to purchase and inexpensive to manufacture.

It is another object of this present invention to provide a football holder for kicking a football that replaces complex structures in the prior art with a set of integrated bungee cords.

It is another object of this present invention to provide a football holder for kicking a football in which the integral bungee cords are readily and inexpensively replaced, and thereby pre-empting the need to replace the entire unit when only a component breaks.

It is another object of this present invention to provide a football holder for kicking a football that integrates aluminum joints, which are readily and inexpensively replaced, and thereby pre-empting the need to replace the entire unit when only a component breaks.

It is another object of this present invention to provide a football holder for kicking a football that provides a wider kicking path, which is more conducive to proper form in place kicking.

It is another object of this present invention to provide a football holder for kicking a football that integrates a set of bungee cords to both hold the disassembled invention when stored and to facilitate the quick unfolding of the folded invention.

It is another object of this present invention to provide a football holder for kicking a football that replaces the need for another person to hold the football for placekicking.

It is another object of this present invention to provide a football holder for kicking a football that simulates to the place kicker a place holder.

It is another object of this present invention to provide a football holder for kicking a football that is not metal, and not considered a weapon with respect to airport security purposes.

It is another object of this present invention to provide a football holder for kicking a football that is weatherproof and will not rust.

These and other objects, aspects and features of the present invention will be better understood from the following detailed description of the preferred embodiment when read in conjunction with the appended drawing figures.

BRIEF DESCRIPTION OF THE DRAWING

The following drawings are illustrative of the invention and are not meant to limit the scope of the invention as encompassed by the claims:

DETAILED DESCRIPTION OF THE PREFERRED EMBODIMENT

Figure 1:
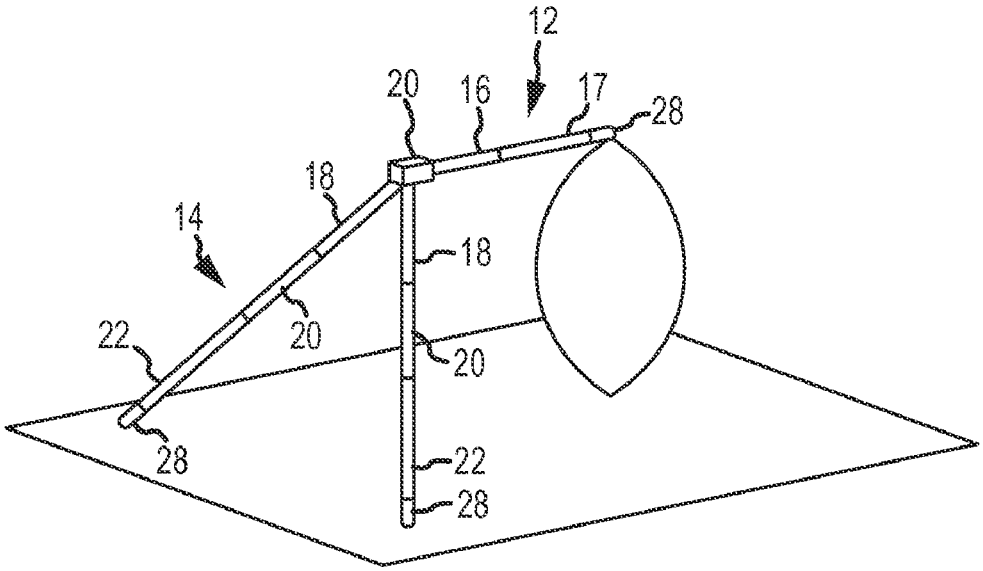
FIG. 1 is a perspective view of the football holder of the present invention shown supporting with a properly placed football relative to the placekicker.

In the preferred embodiment, the football holder is used to hold a football in an upright position for kicking by a place kicker. The holder 10 is comprised of the arm 12 and two legs 14, as seen in FIG. 1. The arm 12 has two sections 16 and 17. The legs 14 each have three sections: an upper section 18, middle section 20 and the lower section 22. In the preferred embodiment, the leg sections 18, 20 and 22 of each leg 14 are equal in lengths, but relative lengths of the constituent sections is not a critical feature, though the over-all dimensions of the holder should be appropriate for accommodating the standard American football for the herein-stated, intended use. Of course, the device could also be downsized, in the even that it were to be used for juvenile-sized footballs.

As depicted in the drawings, each constituent section 16, 17, 18, 20 and 22 of the arm 12 and legs 14 are hollow tubes that nest with its adjacent section by way of a telescopic, nesting interface arrangement. This interface is achieved, in any given pairing, by providing a respective "male" or "female" contouring.

Arm 12 and legs 14 extend from a connector module 20 via suitably sized and shaped, respective contouring of the proximal ends of legs 14 and respective receiving orifices of module 20, in similar fashion to the mating of arm and leg segments 16, 17 18, 20 and 22 as described. In the preferred embodiment, and presently believed best mode of the holder 10, arm and leg segments 16, 17 18, 20 and 22 are made of fiberglass tubing, with the proximal ends of arm 12 and legs 14 terminating with, and engaging with module 20 via metallic caps 23.

Elastic cording ("Bungee cord") 21 extends from module 20, respectively through caps 23 and the hollow tubing of arm 12 and legs 14, with termini being anchored to respective anchor tips 24 (not separately shown in FIGS. 1-3) fixed at respective distal ends of arm 12 and legs 14.

Figure 4:
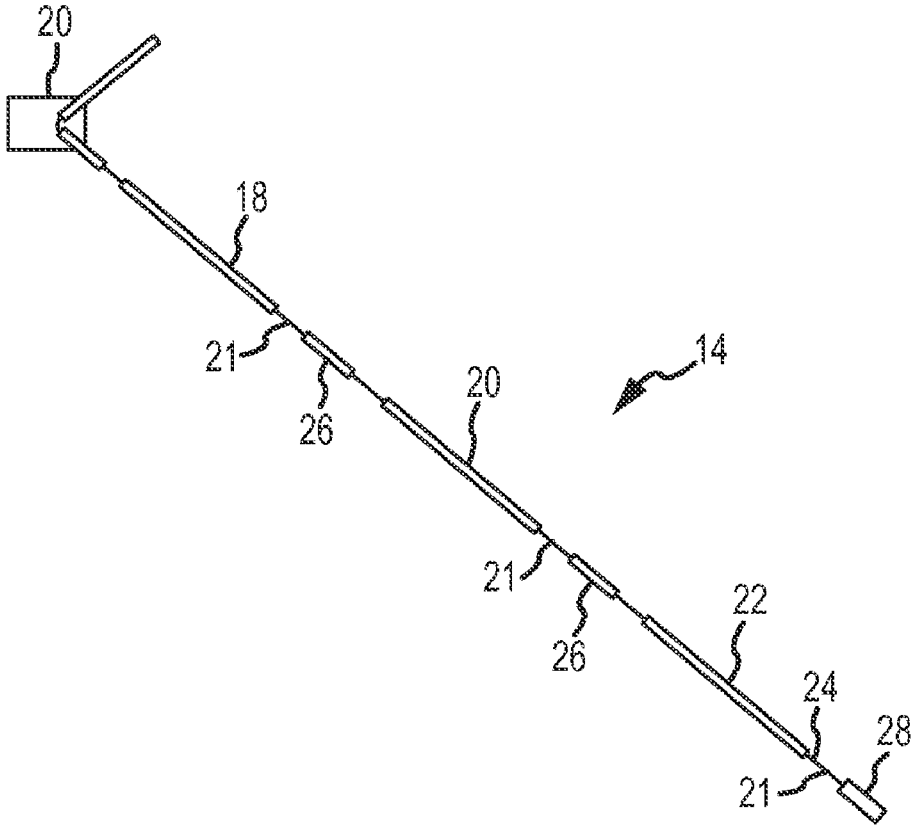
FIG. 4 is a detailed, structural drawing showing the particulars of a leg section structure of a preferred embodiment of the holder of the present invention.
Figure 5:
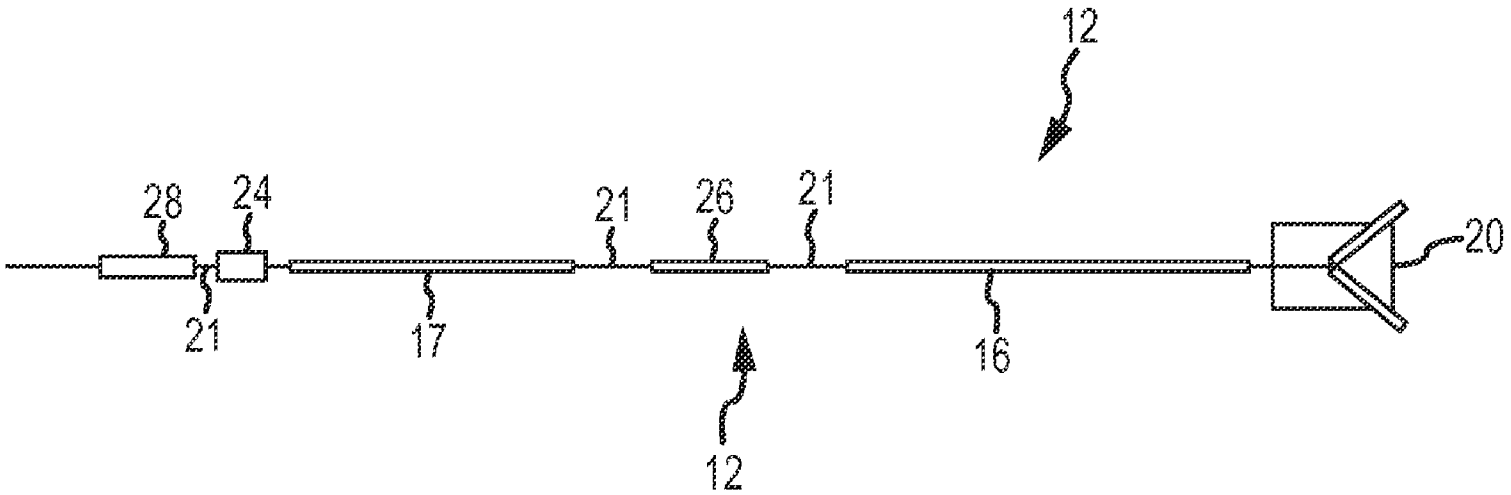
FIG. 5 is a detailed, structural drawing showing the particulars of the arm section structure of a preferred embodiment of the holder of the present invention.

Protective collar members 26 (shown only in FIGS. 4-5) are included in some embodiments of holder 10, prevent damage to the leg and arm segments arm and leg segments 16, 17 18, 20 and 22, and maintain the alignment of segment within circumference tolerance for optimal function of holder 10. Rubber-like, protective arm and leg tips 28 cap the distal ends of leg 12 and arms 14.

Figure 2:
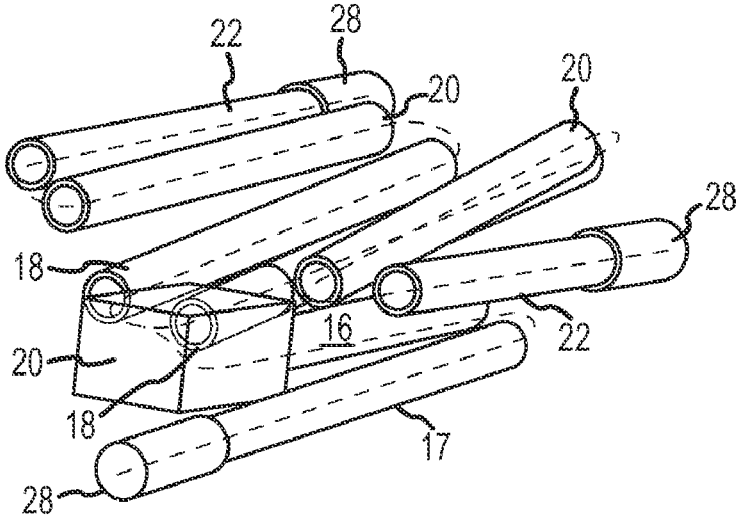
FIG. 2 is the embodiment of FIG. 1 shown in its folded form for easy storage and portability.
Figure 3:
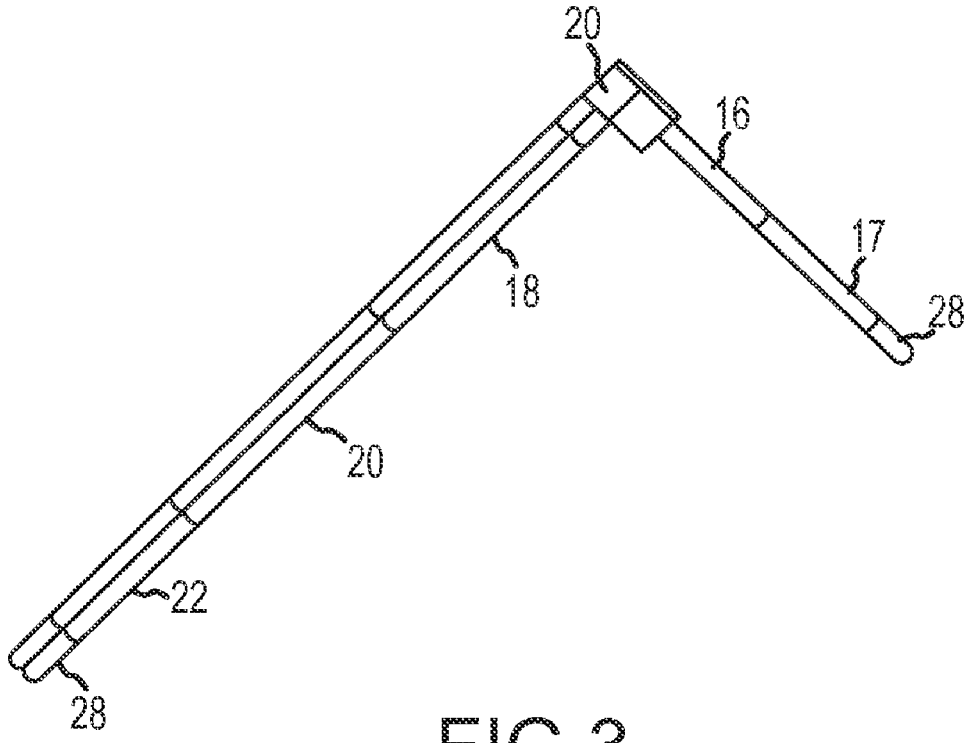
FIG. 3 is a view of the holder of FIG. 2, after it quick snaps out from its storage bag.

Cording 21 is tensioned such that, when the arm 12 and leg 14 sections are interfaced as described, they are maintained, under force of the stretched cording 21, in the useful configuration depicted in FIG. 1. However, when the holder is to be "broken down" for compact storage or transport (as generally depicted in FIG. 2), the stretchable cording allows the sections to be de-nested and folded.

Not only does cording maintain the holder in its desired configuration for use, it also facilitates automatic "rapid deployment" of the device. In other words, the holder 10 very nearly assembles itself (into the configuration shown in FIG. 1) under force of the cording, when a user releases it from its compact configuration, such as when it is stored in a bag, for example.

For the intended purpose of the football holder, both legs are in contact with the ground and the arm contacts and supports the football in the desired vertical position, the distal end of arm 12 engaged with the football simply through gravity and friction. This permits quick release of the holding pressure on the football during kicking and thus, prevents any interference with the kicker while simulating the release of a person holding the football.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A reversibly collapseable football practice kicking holder comprising:

an elongate holder arm having a proximal holder arm end and a distal holder arm end, said holder arm having a plurality of holder arm sections sequentially interfaced to form said holder arm, said holder arm sections having one or more elastic members extending between adjacent said holder arm sections, said elastic members being tensioned, and said sections being configured for reversible interfacing whereby said holder arm sections are disengageable for storage or transport, but are biased, under force of said elastic member toward a holder arm interfaced configuration;

an elongate first holder leg having a proximal first holder leg end and a distal first holder leg, said first holder leg having a plurality of first holder leg sections sequentially interfaced to form said first holder leg, said first holder leg sections having one or more elastic members extending between adjacent said first holder leg sections, said elastic members being tensioned, and said sections being configured for reversible interfacing whereby said first holder leg sections are disengageable for storage or transport, but are biased, under force of said elastic member toward a first holder leg interfaced configuration; and an elongate second holder leg having a proximal second holder leg end and a distal second holder leg, said second holder leg having a plurality of second holder leg sections sequentially interfaced to form said second holder leg, said second holder leg sections having one or more elastic members extending between adjacent said second holder leg sections, said elastic members being tensioned, and said sections being configured for reversible interfacing whereby said second holder leg sections are disengageable for storage or transport, but are biased, under force of said elastic member toward a second holder leg interfaced configuration;

said holder arm, said first holder leg and said second holder leg being coupled at their respective proximal holder arm end, proximal first holder leg end, and proximal second holder leg end to permit formation of a tripod-like composite structure of said holder arm, said first holder leg and said second holder leg when said holder is configured for use by a connector module comprising inserts attached to the holder arm, first holder leg, and second holder leg to allow for a storage position wherein the arm and leg sections are substantially parallel to one another, and to assist in assembling the arm and legs into the tripod-like composite structure under the tension of the elastic members.

2. A method for practicing placekicking using an American football comprising the steps of:

selecting a reversibly collapseable football practice kicking holder comprising:

an elongate holder arm having a proximal holder arm end and a distal holder arm end, said holder arm having a plurality of holder arm sections sequentially interfaced to form said holder arm, said holder arm sections having one or more elastic members extending between adjacent said holder arm sections, said elastic members being tensioned, and said sections being configured for reversible interfacing whereby said holder arm sections are disengageable for storage or transport, but are biased, under force of said elastic member toward a holder arm interfaced configuration;

an elongate first holder leg having a proximal first holder leg end and a distal first holder leg, said first holder leg having a plurality of first holder leg sections sequentially interfaced to form said first holder leg, said first holder leg sections having one or more elastic members extending between adjacent said first holder leg sections, said elastic members being tensioned, and said sections being configured for reversible interfacing whereby said first holder leg sections are disengageable for storage or transport, but are biased, under force of said elastic member toward a first holder leg interfaced configuration; and an elongate second holder leg having a proximal second holder leg end and a distal second holder leg, said second holder leg having a plurality of second holder leg sections sequentially interfaced to form said second holder leg, said second holder leg sections having one or more elastic members extending between adjacent said second holder leg sections, said elastic members being tensioned, and said sections being configured for reversible interfacing whereby said second holder leg sections are disengageable for storage or transport, but are biased, under force of said elastic member toward a second holder leg interfaced configuration;

said holder arm, said first holder leg and said second holder leg being coupled at their respective proximal holder leg end, proximal first holder leg end, proximal second holder leg end to permit formation of a tripod-like composite structure of said holder arm, said first holder leg and said second holder leg when said holder is configured for use by a connector module comprising inserts attached to the holder arm, first holder leg, and second holder leg to allow for a storage position wherein the arm and leg sections are substantially parallel to one another, and to assist in assembling the arm and legs into the tripod-like composite structure under the tension of the elastic members;

configuring said holder for use;

selecting an American football and orienting said football in a desired position and orientation for placekicking practice;

resting said distal holder end of said holder against the uppermost terminus of said football, thereby maintaining said football in said position and orientation for placekicking practice; and kicking said football while being held in position by said holder.

* * * * *